US010140971B2

(12) United States Patent
Sun et al.

(10) Patent No.: US 10,140,971 B2
(45) Date of Patent: Nov. 27, 2018

(54) ON-SITE SPEAKER DEVICE, ON-SITE SPEECH BROADCASTING SYSTEM AND METHOD THEREOF

(71) Applicant: SCHNEIDER ELECTRIC INDUSTRIES SAS, Rueil-Malmaison (FR)

(72) Inventors: Yuanhai Sun, Shanghai (CN); Jingchuan Ma, Shanghai (CN)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/739,166

(22) Filed: Jun. 15, 2015

(65) Prior Publication Data

US 2015/0364126 A1 Dec. 17, 2015

(30) Foreign Application Priority Data

Jun. 16, 2014 (CN) ..... 2014 1 0268585

(51) Int. Cl.
*G10L 13/02* (2013.01)
*G08B 25/01* (2006.01)
*G10L 13/00* (2006.01)

(52) U.S. Cl.
CPC ..... *G10L 13/02* (2013.01); *G08B 25/012* (2013.01); *G10L 13/00* (2013.01)

(58) Field of Classification Search
USPC ..... 704/258–260, 270, 9, 235; 455/414.1, 455/404.1, 404.2; 84/723; 379/88.01;
(Continued)

(56) References Cited

U.S. PATENT DOCUMENTS 5,966,691 A 10/1999 Kibre et al.
8,265,938 B1 9/2012 Verna et al.
(Continued)

FOREIGN PATENT DOCUMENTS

JP H04-175049 A 6/1992
JP H09-18600 A 1/1997
KR 101216741 B1 12/2012

OTHER PUBLICATIONS

"GAMEWELL-FCI Text-to-Speech Module Unified MNS Voice Notification Description'", Dec. 31, 2011.(Dec. 31, 2011), XP055219309, Retrieved from the Internet: URL:https://www.gamewell-fci.com/datasheets/GF12008.pdf [retrieved on Oct. 8, 2015].
(Continued)

*Primary Examiner* — Neeraj Sharma
(74) *Attorney, Agent, or Firm* — Lando & Anastasi, LLP

(57) ABSTRACT

Embodiments of the present disclosure provide a method of on-site speech broadcasting. The method includes receiving text signal, wherein the text signal is generated in response to a parameter reaching a predetermined value sensed by an on-site sensor (110) arranged in the field; converting the text signal to a speech signal by a speech converting module (210) disposed within an on-site speaker device (200); playing the converted speech signal by using a speaker (220) of the on-site speaker device (200). Embodiments of the present disclosure also provide an on-site speaker device and an on-site speech broadcasting system. With the embodiments of the present disclosure, an effective text-to-speech conversion is achieved, pre-created speech data is not necessary and the workload of design is reduced, making it more cost effective. Meanwhile, speech messages being broadcasted allow operators instantaneously knowing the content of the alarm. Therefore, the operators are able to
(Continued)

position and tackle the problem right away, improving efficiency and safety.

7 Claims, 3 Drawing Sheets

(58) Field of Classification Search
USPC ..... 340/545.6, 517; 709/238; 348/14.08
See application file for complete search history.

(56) References Cited

U.S. PATENT DOCUMENTS 8,340,975 B1 * 12/2012 Rosenberger ..... G10L 15/22 704/270
8,766,805 B2 * 7/2014 Alameh ..... G08B 21/24 340/573.1
8,868,427 B2 * 10/2014 Rysenga ..... G06Q 10/109 340/521
2002/0094067 A1 * 7/2002 August ..... H04M 3/42153 379/88.01
2004/0226047 A1 * 11/2004 Lin ..... G09B 5/06 725/109
2005/0159132 A1 * 7/2005 Wright ..... H04L 12/58 455/404.1
2007/0078655 A1 4/2007 Semkow et al.
2008/0111685 A1 * 5/2008 Olson ..... B65D 55/028 340/545.6
2009/0024759 A1 * 1/2009 McKibben ..... G08B 27/006 709/238
2009/0083035 A1 * 3/2009 Huang ..... G10L 13/08 704/260
2009/0305659 A1 * 12/2009 Hochendoner ..... H04L 12/1895 455/404.1
2009/0306985 A1 * 12/2009 Roberts ..... G10L 13/043 704/258
2010/0033318 A1 2/2010 Tampke
2010/0189887 A1 * 7/2010 Nielsen ..... G06Q 10/06 427/136
2012/0046949 A1 * 2/2012 Leddy ..... G10L 13/033 704/260
2012/0112901 A1 * 5/2012 Chasko ..... G08B 21/10 340/517
2012/0190325 A1 * 7/2012 Abu-Hakima ..... H04L 12/1845 455/404.2
2012/0227570 A1 * 9/2012 Chang ..... H04W 4/006 84/464 R
2013/0077772 A1 * 3/2013 Lichorowic ..... H04M 1/271 379/88.02
2013/0157609 A1 * 6/2013 Vainik ..... G06F 11/0781 455/404.1
2014/0139616 A1 * 5/2014 Pinter ..... A61B 5/0008 348/14.08
2014/0164476 A1 * 6/2014 Thomson ..... G06Q 10/101 709/203
2014/0242955 A1 * 8/2014 Kang ..... G06F 17/289 455/414.1
2015/0078539 A1 * 3/2015 Jain ..... H04M 3/493 379/88.01
2015/0207908 A1 * 7/2015 Hosoda ..... G06F 1/1626 455/566
2015/0242182 A1 * 8/2015 McAdam ..... G05B 19/409 700/83
2015/0338917 A1 * 11/2015 Steiner ..... H04L 9/3231 345/156
2015/0364128 A1 * 12/2015 Zhao ..... G06N 3/0445 704/259
2015/0371627 A1 * 12/2015 Lee ..... G10L 15/22 704/235
2016/0179787 A1 * 6/2016 Deleeuw ..... G06F 17/2785 704/9
2018/0032997 A1 * 2/2018 Gordon ..... G06Q 20/3224

OTHER PUBLICATIONS

Extended European Search Report from corresponding European Application No. 15305925.8 dated Oct. 28, 2015.
Sproat R: "Sable: A Standard for TTS Markup", 19981001, Oct. 1, 1998 (Oct. 1, 1998), p. P40, XP007000023.
Extended European Search Report from corresponding European Application No. 15305925.8 dated Nov. 20, 2015.
Japanese Office Action from corresponding Japense Patent Application No. 2015-121535 dated Aug. 3, 2016 [English Translation attached].
European Office Action from corresponding European Application No. 15305925.8 dated Mar. 23, 2017.
Japanese Decision of Rejection from corresponding Japense Patent Application No. 2015-121535 dated Mar. 23, 2017 [English Translation attached].

* cited by examiner

ON-SITE SPEAKER DEVICE, ON-SITE SPEECH BROADCASTING SYSTEM AND METHOD THEREOF

CROSS REFERENCE TO RELATED APPLICATION

This application claims the benefit under 35 U.S.C. § 119 of Chinese Patent Application No. 201410268585.5 filed on Jun. 16, 2014 which is hereby incorporated herein by reference in its entirety for all purposes.

TECHNOLOGY

Embodiments of the present disclosure relate to an on-site speaker device, an on-site speech broadcasting system and a method of on-site speech broadcasting, and more specifically, to an on-site speaker device, an on-site speech broadcasting system and a method of on-site speech broadcasting for converting texts to speeches and playing the speeches.

BACKGROUND

Existing alarm devices, such as the alarm devices used for production line, usually inform an occurrence of a particular event to operators or workers in the plant by way of flashing light. Such a particular event may be an accident affecting the production (for example, equipment may stop working) or a condition affecting the safety of the production (for example, gas leakage and the like). Although the combination of flashing light and alarm sound does well in alerting, the operators may not easily understand instantaneously what the problem is. The operators have to move to where the human machine interface is for an inspection so as to identify and then solve the problem before the production resumes. Therefore, the conventional way mentioned above is not suitable to quickly solve problems.

The use of speech in the workplace such as plant for broadcasting is more intuitive compared with the combination of flashing light and alarm sound. Speeches allow all of the people in the field understanding instantaneously what the specific problem is going on, making a quick response possible. The existing speech broadcasting requires manufacturers to record a great amount of speech data beforehand, which can be realized manually or by text-to-speech software. After the great amount of speech data is recorded, the data is configured and programmed in a controller such as programmable logic controller (PLC). Certain limitations exist for the above way. The recording process is time consuming and the maintenance cost is relatively high. For instance, when speech data is modified or added, previously recorded speeches need to be checked and analyzed, and consistent parameters such as voice and tone are utilized for the new recording.

SUMMARY

In view of the above, one of the objectives of implementations of the present disclosure is to provide a method of on-site speech broadcasting, which does not require pre-creating speech data by an effective text-to-speech conversion, while the workload of design is reduced, making it more cost effective.

In addition, another objective of implementations of the present disclosure is to provide an on-site speaker device which is capable of conducting the text-to-speech process, and an on-site speech broadcasting system utilizing the device.

In accordance with one aspect of the present disclosure, a method of on-site speech broadcasting is provided. The method includes: receiving a text signal, wherein the text signal is generated in response to a parameter sensed by an on-site sensor reaching a predetermined value; converting the text signal to a speech signal by a speech converting module disposed within an on-site speaker device; and playing the converted speech signal by using a speaker of the on-site speaker device.

In accordance with one embodiment of the present disclosure, the text signal may be generated by selecting from a plurality of texts preset by the user in response to the parameter sensed by the on-site sensor reaching the predetermined value.

In accordance with one embodiment of the present disclosure, transmitting may be a wireless transmission via a transmitting interface in a text generating device.

In accordance with one embodiment of the present disclosure, the method may further include inserting a mark in the text signal, the mark indicating a requirement of text-to-speech conversion, such that the speech converting module converts the text signal to the speech signal in accordance with the requirement.

In accordance with one embodiment of the present disclosure, the text signal may comprise at least two languages.

In accordance with another aspect of the present disclosure, an on-site speaker device is provided. The device includes a receiving interface for receiving a text signal, wherein the text signal is generated in response to a parameter sensed by an on-site sensor reaching a predetermined value; a speech converting module for converting the text signal to a speech signal; and a speaker for playing the speech signal.

In accordance with one embodiment of the present disclosure, the speech converting module may be capable of converting the text signal to the speech signal in accordance with a requirement of text-to-speech conversion indicated by a mark in the text signal.

In accordance with one embodiment of the present disclosure, the text signal may comprise at least two languages.

In accordance with another aspect of the present disclosure, an on-site speech broadcasting system is provided. The system includes a text generating device for generating a text signal and the on-site speaker device as described above. The text generating device has: a sensor being capable of sensing a parameter reaching a predetermined value; a human machine interface for generating the text signal in response to the parameter sensed by the sensor reaching the predetermined value; and a transmitting interface for transmitting the text signal.

In accordance with one embodiment of the present disclosure, the text generating device may be configured to generate the text signal by selecting from a plurality of texts preset by the user via the human machine interface in response to the parameter sensed by the sensor reaching the predetermined value.

Because the text-to-speech process is achieved by the on-site speaker device, multiple on-site speaker devices may be arranged in the field and communicate with the text generating device, so that broadcasting contents are hearable in various positions in the field, which is especially advantageous for large plants. Further, the communication between the on-site speaker device and the text generating device only needs to meet requirements for text signal transferring, making all sorts of connection and/or communication possible. It also improves compatibility of on-site speaker devices, meaning that the devices can be connected with various brands of text generating devices.

DESCRIPTION OF DRAWINGS

By way of example only, the embodiments of the present disclosure will be described with reference to the accompanying drawings, wherein.

DESCRIPTION OF EXAMPLE EMBODIMENTS

The embodiments of the present disclosure are now described in detail in combination with the accompanying drawings. It is to be noted that similar parts or functional components throughout the figures may be denoted with same numeral references. The figures are only intended to illustrate but not to limit the embodiments of the present disclosure. Those skilled in the art may obtain alternative technical solutions from the following descriptions without departing from the spirit and scope of protection of the present disclosure.

The implementations of the present disclosure are mainly described in the example of an alarm of a production line. It is to be understood that, however, sites and environments of the speech broadcasting are not to be limited by the present disclosure. The present disclosure can be applicable to any site requiring speech broadcasting, for example: production plants, elevator systems, mining and exploration for petroleum, coal and metal resources, subway/railway stations, parking lots, hospitals, banks, power plants, laboratories or the like. Those skilled in the art may make various modifications and changes to the embodiments under the teachings of the present disclosure by reading the specification and accompanying drawings. On-site speech broadcasting methods, systems and on-site speaker devices limited by the spirit and scope of the claims should be considered in the scope of protection of the present disclosure. Various embodiments of the present disclosure are to be described in combination with the figures in the following.

Figure 1:
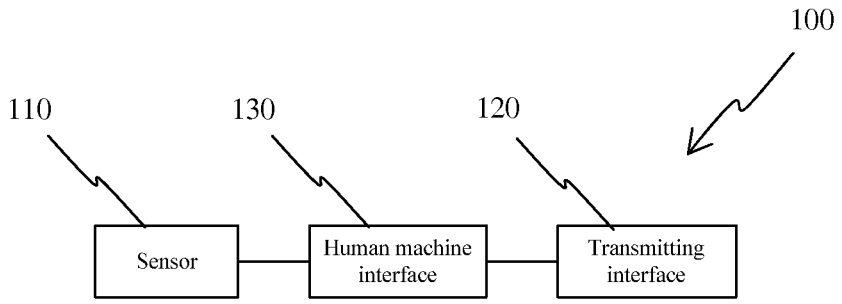
FIG. 1 illustrates a block diagram of a text generating device in accordance with an embodiment of the present disclosure.
Figure 2:
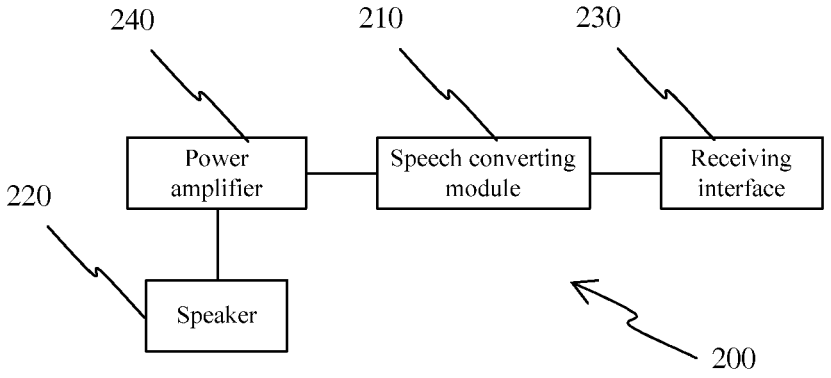
FIG. 2 illustrates a block diagram of an on-site speaker device in accordance with an embodiment of the present disclosure.
Figure 3:
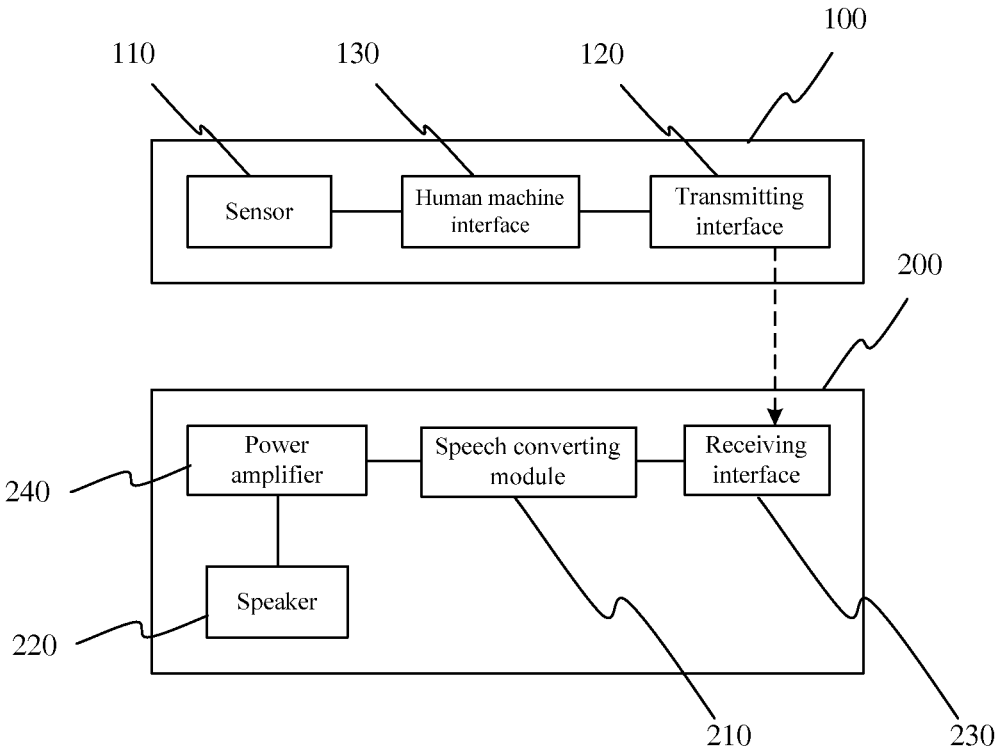
FIG. 3 illustrates a block diagram of an on-site speech broadcasting system in accordance with an embodiment of the present disclosure.
Figure 4:
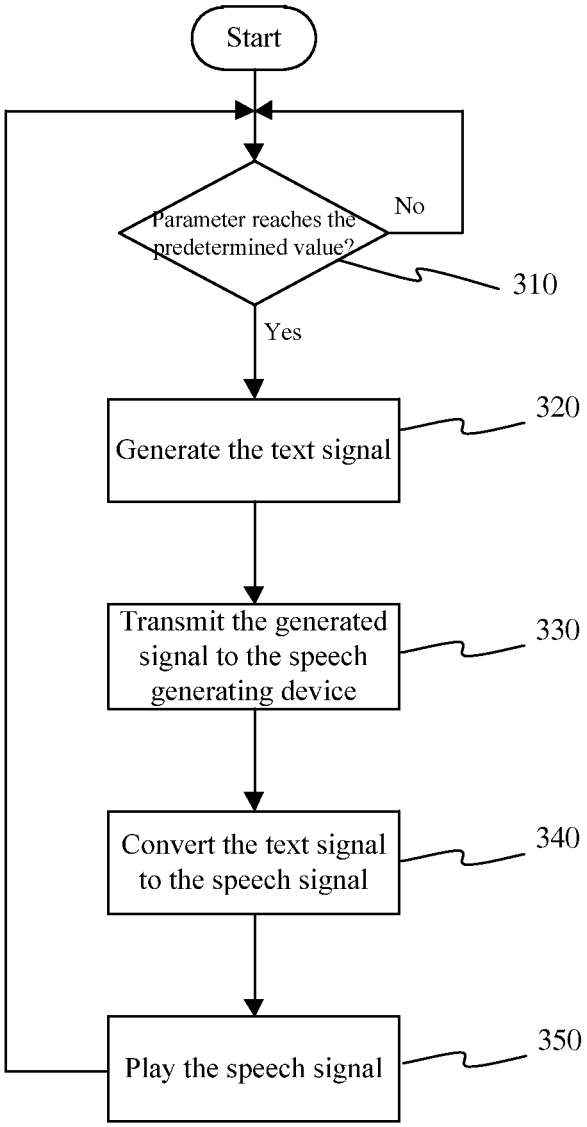
FIG. 4 illustrates a block diagram of a method of on-site speech broadcasting in accordance with an embodiment of the present disclosure.

FIG. 1 illustrates a block diagram of a text generating device 100 in accordance with an embodiment of the present disclosure. FIG. 2 illustrates a block diagram of an on-site speaker device 200 in accordance with an embodiment of the present disclosure. FIG. 3 illustrates a block diagram of an on-site speech broadcasting system in accordance with an embodiment of the present disclosure. FIG. 4 illustrates a block diagram of a method of on-site speech broadcasting in accordance with an embodiment of the present disclosure.

As shown in FIG. 1, the text generating device 100 includes a sensor 110, a human machine interface 130 and a transmitting interface 120. The text generating device 100 may be a clearly separated product formed by an enclosure, and may be integrated inside other devices such as controlling devices of industrial computers.

In accordance with an embodiment of the present disclosure, the quantity of the sensor 110 is not to be limited. Multiple sensors 110 may be used and each of them is positioned in the field at different places far from the human machine interface 130, or at positions of different devices to be sensed. A single sensor 110 such as a humidity sensor or a light sensor can also be used in the vicinity of the human machine interface 130. Alternatively, some sensors 110 may be used in the vicinity of the human machine interface 130, allowing some other sensors 110 to be positioned at different places far from the human machine interface 130. Types of the sensors 110 are not to be limited by the implementations of the present disclosure. Types and specifications of the sensors can be chosen based on the users' requirements.

In accordance with an embodiment of the present disclosure, the sensor 110 is coupled to the human machine interface 130. However, the embodiments of the present disclosure do not limit the way of coupling. For example, such a way of coupling can be wired connection by wires or wireless connection by a pair of wireless transceiver modules. The human machine interface 130 in general has an input device and a display device, also a controller capable of processing signals from various sensors 110. Although input devices and display devices of common industrial human machine interface 130 are integrated in the human machine interface 130 itself, the forms and positions of the input devices and the display devices are not to be limited by the implementations of the present disclosure.

In accordance with an embodiment of the present disclosure, the human machine interface 130 may store multiple texts, and the users may edit, amend, update, delete and add any required text information at any time via the input device. The text information is the speech information that the user would like to broadcast. Each entry may only correspond to a status of a particular sensor 110. By way of example, one temperature sensor is positioned at a position to be sensed inside a first furnace. When the temperature at that position reaches or raises above a value preset by the user beforehand, the processor of the human machine interface 130 is able to determine an event of over-temperature furnace by a signal from the temperature sensor. The particular event in turn corresponds to a certain entry "$1^{st}$ furnace over heated" inputted by the user beforehand via the input device. However, each entry can also correspond to statuses of multiple sensors 110. By way of example, multiple temperature sensors are placed at the positions to be sensed inside a second furnace. When a temperature value such as an average temperature value at multiple positions inside the furnace drops to or below a value preset by the user, the processor of the human machine interface 130 is able to determine an event of overall insufficient-temperature furnace by a signal from the temperature sensors. The particular event in turn corresponds to a certain entry "$2^{nd}$ furnace insufficiently heated" inputted by the user beforehand via the input device. Of course, when all or some or one of statuses of a number of sensors of different types such as temperature sensors, pressure sensors, flow rate sensors and the like reach their respective preset values, the processor of the human machine interface 130 is able to determine a certain device is abnormal based on the signals from these sensors of different types. The particular event corresponds to a certain text such as "device # abnormal" inputted by the user beforehand via the input device.

In accordance with an embodiment of the present disclosure, the text entry selected and generated by the text generating device 100 can be of single language and also multiple languages mixed together, such as a sentence in Chinese inserted with English words. Therefore, in order to avoid the generated text becoming gibberish or unreadable code, the text generating device 100 supports texts of multiple encoding formats such as Unicode, Chinese GB2312, Chinese GBK, Chinese BIG5 and the like.

In accordance with an embodiment of the present disclosure, once a certain text is selected by the human machine interface 130, the text signal will be transferred to a transmitting interface 120 coupled with the human machine interface 130. The transmitting interface 120 can be an interface of a remote terminal unit (RTU) utilizing Modbus protocol, such as RS 485 communication interface, for wireless communication. It can also be an interface utilizing, for example, Universal Asynchronous Receiver/Transmitter (UART) for wired communication.

As shown in FIG. 2, an on-site speaker device 200 includes a receiving interface 230, a speech converting module 210, a power amplifier 240 and a speaker 220. The on-site speaker device 200 can be a clearly separated product formed by an enclosure, or can also be integrated inside other devices. The implementations of the present disclosure do not limit the number of the speakers of each of the speech converting module 210. For example, multiple speakers may be arranged to face different directions.

In accordance with an embodiment of the present disclosure, a receiving interface 230, like the transmitting interface 120 shown in FIG. 1, can be an interface of a remote terminal unit (RTU) utilizing Modbus protocol, such as RS 485 communication interface, for wireless communication, or an interface utilizing, for example, Universal Asynchronous Receiver/Transmitter (UART) for wired communication. The receiving interface 230 is used to receive text signals and transfer the received text signals to the speech converting module 210 coupled with the receiving interface 230.

In accordance with an embodiment of the present disclosure, the speech converting module 210 supports in the text signals in multiple languages converting to speech signals, and allows the text signal mixed with at least two languages into the speech signals, so as to realize the ability of mixed reading. For example, the text signal mixed with at least two languages can be Chinese sentences with English words or abbreviations. In addition, the speech converting module 210 can identify various marks, which indicate requirements for converting text to speech. For example, the speech converting module 210 will firstly identify an announcer mark inserted in the text signal. A required announcer is selected based on the mark, and the text signal is converted to the speech signal with a particular announcer voice feature (for example, man voice or woman voice). As described above, a text control mark may be inserted into the expected text by the user with the human machine interface 130.

In accordance with an embodiment of the present disclosure, the generated speech signal converted by the speech converting module 210 may be a digital audio signal in WAV format for example. The signal is in turn converted to an analog audio signal by a digital-to-audio converter (DAC) and amplified by the power amplifier 240 so as to be broadcasted by the speaker 220. Alternatively, a DAC module inside the speech converting module 210 can also be used to directly convert the digital signal to the analog audio signal and output to the power amplifier 240. The position and way of digital-to-analog conversion as well as the types of the power amplifier 240 and speaker 220 are not to be limited by the implementations of the present disclosure. Designers are able to select appropriate power amplifiers and speakers, or other parts such as processors for generating speech signals as needed.

FIG. 3 illustrates a block diagram of an on-site speech broadcasting system in accordance with an embodiment of the present disclosure. The system includes the text generating device 100 and at least one on-site speaker device 200 coupled with the text generating device 100. The transmitting interface 120 of the text generating device 100 can be coupled with the receiving interface 230 of each on-site speaker device 200, and transfer the text signal to each receiving interface 230. As described above, the transmitting interface 120 can be coupled with the receiving interface 230 in a wireless manner or a wired manner. For example, a number of on-site speaker devices 200 with wireless receiving ability may be arranged at different positions in a relatively large plant. When a certain sensor 110 of the text generating device 100 senses an occurrence of a preset event, the human machine interface 130 automatically selects preset text information and generates the corresponding text signal, which is transmitted to the receiving interface 230 of each on-site speaker device 200 via the transmitting interface 120. Then, the speech converting module 210 of each on-site speaker device 200 converts the received text signal to the speech signal, which is then broadcasted through the speaker 220 of each of the on-site speaker devices 200.

FIG. 4 illustrates a block diagram of a method of on-site speech broadcasting in accordance with an embodiment of the present disclosure. At step 310, all of the sensors 110 keeps operating and sensing their respective parameters. Next steps will not be proceeded with if the respective parameters do not reach the predetermined values. The text generating device 100 generates the text signal at step 320 by the text generating device 100 if one of the sensors 110 detects a parameter reaching the predetermined value. Then, at step 330, the generated text signal is transmitted from the text generating device 100 to the on-site speaker device 200. At step 340, the text signal is converted to the speech signal by the speech converting module 210 disposed in the on-site speaker device 200. Last, at step 350, the speaker 220 of the on-site speaker device 200 is used to play the converted speech signal.

By the on-site broadcasting method, device and the on-site speech broadcasting system of the embodiments of the present disclosure, no speech data needs to be created for manufacturers, and thus the workload of design is reduced and the manufacturing cost is lowered. The users would listen to consistent and coherent speech alarm instead of text alarm or sound/light alarm in case of a special event occurs, so as to understand the problem instantaneously. As a result, the efficiency and safety are improved. In addition, because the converting process from text to speech occurs at one end of the on-site speaker device, it is not required to modify the existing production line. Only the controllers in the human machine interfaces are needed to be programmed to preset text information corresponding to a number of events. Therefore, such an on-site speaker device has excellent compatibility, and is applicable to the human machine interfaces of different brands and can be matched with most programmable logic controllers.

Through teachings from the above descriptions and associated drawings, numerous modifications and other implementations of the present disclosure set forth herein will be appreciated by persons skilled in the art. Therefore, it is to be understood that the implementations of the present disclosure are not limited to the specific embodiments of the disclosed herein, and modifications and other implementations are intended to be included within the scope of the present disclosure. In addition, although exemplary embodiments have been described by the above descriptions and associated drawings in some exemplary combination of components and/or functions, it should be appreciated that, alternative embodiments may be provided by different combinations of members and/or functions without departing from the scope of the present disclosure. In this regard, for example, other combinations of components and/or functions different from what have been explicitly described above are also expected to be within the scope of the present disclosure. Although specific terms are used herein, they are used in a generic and descriptive sense only and not intended for limiting.

What is claimed is:

1. A method of on-site speech broadcasting, comprising:

receiving a text signal, wherein the text signal is automatically generated by an on-site text-generating device in response to a parameter in an industrial environment sensed by an on-site sensor of the on-site text-generating device reaching a predetermined value;

converting the text signal to a speech signal by an on-site speech converting module disposed within an on-site speaker device separated from the on-site text-generating device; and playing the converted speech signal by using a speaker of the on-site speaker device to broadcast an alarm in the industrial environment, wherein the text signal is generated by automatically selecting the text signal from a plurality of text signals preset by an on-site user to correspond to the parameter reaching the predetermined value, wherein the on-site text-generating device further includes a human machine interface for automatically selecting a text from a plurality of texts without input of the on-site user, and a transmitting interface for transmitting the text signal, wherein the human machine interface comprises a processor for determining an event indicating a certain device in the industrial environment is abnormal based on the parameter sensed by the on-site sensor, and wherein the text of the plurality of texts corresponds to the event.

2. The method according to claim 1, further comprising inserting a mark in the text signal, the mark indicating a requirement of text-to-speech conversion, such that the on-site speech converting module converts the text signal to the speech signal in accordance with the requirement.

3. The method according to claim 1, wherein the text signal comprises at least two languages.

4. An on-site speaker device, comprising:

a receiving interface configured for receiving a text signal, wherein the text signal is automatically generated by an on-site text-generating device separated from the on-site speaker device in response to a parameter in an industrial environment sensed by an on-site sensor of the on-site text-generating device reaching a predetermined value;

an on-site speech converting module configured for converting the text signal to a speech signal; and an on-site speaker configured for playing the speech signal and configured to broadcast an alarm in the industrial environment, wherein the text signal is automatically generated by selecting the text signal from a plurality of text signals preset by an on-site user to correspond to the parameter sensed by the on-site sensor reaching the predetermined value, wherein the on-site text generating device further includes a human machine interface for automatically selecting a text from a plurality of texts without input of the on-site user, and a transmitting interface for transmitting the text signal, wherein the human machine interface comprises a processor for determining an event indicating a certain device in the industrial environment is abnormal based on the parameter sensed by the on-site sensor, and wherein the text of the plurality of texts corresponds to the event.

5. The on-site speaker device according to claim 3, wherein the on-site speech converting module is capable of converting the text signal to the speech signal in accordance with a requirement of text-to-speech conversion indicated by a mark in the text signal.

6. The on-site speaker device according to claim 4, wherein the text signal comprises at least two languages.

7. An on-site speech broadcasting system, comprising:

i.) an on-site text generating device for generating a text signal, having:

an on-site sensor configured for sensing a parameter in an industrial environment reaching a predetermined value;

an on-site human machine interface configured for automatically generating a text signal in response to the parameter sensed by the on-site sensor reaching the predetermined value, the human machine interface being configured for automatically selecting a text from a plurality of texts without input of an on-site user, wherein the text signal is generated by automatically selecting the text signal from a plurality of text signals preset by the on-site user to correspond to the parameter sensed by the on-site sensor reaching the predetermined value; and an on-site transmitting interface configured for transmitting the generated text signal; and ii.) an on-site speaker device, separated from the on-site text-generating device, including:

an on-site receiving interface configured for receiving the transmitted generated text signal;

an on-site speech converting module configured for converting the received text signal to a speech signal; and an on-site speaker configured for playing the speech signal and configured to broadcast an alarm in the industrial environment, wherein the human machine interface comprises a processor for determining an event indicating a certain device in the industrial environment is abnormal based on the parameter sensed by the on-site sensor, and wherein the text of the plurality of texts corresponds to the event.

* * * * *